US007461511B2

(12) United States Patent
Kim et al.

(10) Patent No.: US 7,461,511 B2
(45) Date of Patent: Dec. 9, 2008

(54) AIR CLEANER

(75) Inventors: Kyung Hwan Kim, Seoul (KR); Ju-Youn Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 596 days.

(21) Appl. No.: 10/911,494

(22) Filed: Aug. 5, 2004

(65) Prior Publication Data

US 2005/0081556 A1 Apr. 21, 2005

(30) Foreign Application Priority Data

Aug. 22, 2003 (KR) ..... 10-2003-0058305

(51) Int. Cl.
*F25B 21/02* (2006.01)

(52) U.S. Cl. ..... 62/3.3; 62/303; 62/427

(58) Field of Classification Search ..... 62/3.2, 62/3.3, 3.7, 53, 54, 96, 186, 263, 303, 317, 62/427; 237/2 B; 123/556, 552; 126/110; 454/187; 165/1; 366/342; 55/467
See application file for complete search history.

(56) References Cited

U.S. PATENT DOCUMENTS

| | | | | |
|---|---|---|---|---|
| 3,831,395 | A * | 8/1974 | Levy | 62/263 |
| 4,007,600 | A * | 2/1977 | Simms | 62/3.6 |
| 4,048,811 | A * | 9/1977 | Ito et al. | 62/263 |
| 4,325,352 | A * | 4/1982 | Dirkes | 126/110 A |
| 5,761,908 | A * | 6/1998 | Oas et al. | 62/3.2 |
| 6,102,012 | A * | 8/2000 | Iiboshi et al. | 123/556 |
| 6,178,765 | B1 * | 1/2001 | Hironaka et al. | 62/303 |
| 6,338,382 | B1 * | 1/2002 | Takahashi et al. | 165/96 |
| 6,574,967 | B1 | 6/2003 | Park et al. | |

FOREIGN PATENT DOCUMENTS

| | | |
|---|---|---|
| CN | 2515576 | 10/2002 |
| CN | 1435608 | 8/2003 |
| KR | 20-194349 | 6/2000 |
| KR | 20010096107 | 11/2001 |
| KR | 20020026724 | 4/2002 |

OTHER PUBLICATIONS

English Language Abstract of Korean 2002-0026724.
English Language Abstract of Korean 2001-0096107.
English Language Abstract of Korean 20-194349.
English Language Abstract of CN 1435608.
U.S. Appl. No. 10/754,514 to Kim et al.
U.S. Appl. No. 10/754,599 to Yum et al.
U.S. Appl. No. 10/754,579 to Lee et al.
U.S. Appl. No. 10/754,534 to Choi et al.

* cited by examiner

*Primary Examiner*—Melvin Jones
(74) *Attorney, Agent, or Firm*—Greenblum & Bernstein, P.L.C.

(57) ABSTRACT

Air cleaner including a case having an inlet and an outlet, a fan inside of the case, for drawing air through the inlet and discharging the air through the outlet, a filter assembly inside of the case for cleaning the air drawn into the case through the inlet, a heat exchanger inside of the case for heating or cooling the air drawn into the case, selectively, and a plurality of fins between the fan and the outlet for guiding the air drawn into the case to the outlet, thereby ventilating the room.

23 Claims, 3 Drawing Sheets

AIR CLEANER

This application claims the benefit of the Korean Application No. P2003-0058305 filed on Aug. 22, 2003, which is hereby incorporated by reference.

BACKGROUND OF THE INVENTION

1. Field of the Invention

The present invention relates to air cleaners, and more particularly, to an air cleaner for discharging air to a room uniformly, or controlling a temperature of the air discharged to the room.

2. Description of the Related Art

The air cleaner draws air from the room, removes foreign matters from the air, and supplies cleaned air to the room again. As air pollution becomes heavy, and a living standard becomes high, recently the air cleaner is spread widely. In general, the air cleaner is provided with a case, an inlet, an outlet, a filter, and a fan.

In the meantime, the air cleaner discharges air from the fan, not through an entire outlet uniformly, but through only a portion of the outlet, leading to fail to supply the cleaned air to the room, uniformly.

Moreover, though the air cleaner performs cleaning of room air actually, since the user can not sense the function of cleaning actually, the user's reliability on the product is not high.

Furthermore, since a temperature of cleaned air is the same with a room temperature, the air cleaner causes unpleasant feeling when the cleaned air comes into contact with skin of the user during summer or winter.

SUMMARY OF THE INVENTION

Accordingly, the present invention is directed to an air cleaner that substantially obviates one or more of the problems due to limitations and disadvantages of the related art.

An object of the present invention is to provide an air cleaner which can discharges cleaned air through entire area of an outlet of the air cleaner, and has a function for controlling a temperature of air discharged to the room so to be felt comfortable to the user.

Additional features and advantages of the invention will be set forth in the description which follows, and in part will be apparent to those having ordinary skill in the art upon examination of the following or may be learned from practice of the invention. The objectives and other advantages of the invention will be realized and attained by the structure particularly pointed out in the written description and claims hereof as well as the appended drawings.

To achieve these objects and other advantages and in accordance with the purpose of the present invention, as embodied and broadly described herein, the air cleaner includes a case having an inlet and an outlet, a fan inside of the case, for drawing air through the inlet and discharging the air through the outlet, a filter assembly inside of the case for cleaning the air drawn into the case through the inlet, a heat exchanger inside of the case for heating or cooling the air drawn into the case selectively, and a plurality of fins between the fan and the outlet for guiding the air drawn into the case to the outlet.

The plurality of fins guide the air drawn into the case to an entire area of the outlet.

Preferably, the plurality of fins have a distance between adjacent fins which becomes the greater as it goes toward the outlet the farther.

Preferably, the plurality of fins have lengths which become the longer as the fins are arranged at positions of which distances from an outlet of the fan to the outlet of the case are the greater.

Preferably, the plurality of fins have lengths which are fixed in proportion to distances from an outlet of the fan to the outlet of the case are the greater.

Preferably, the plurality of fins are curved for smooth air flow.

The heat exchanger preferably heats or cools the air drawn into the case depending on a direction of a current applied to the heat exchanger.

The heat exchanger preferably includes a first face arranged to be in contact with the air drawn into the case, for generating/absorbing heat, a second face arranged not to be in contact with the air drawn into the case, for making a reaction opposite to the first face, and a thermoelectric module connected between the first face and the second face.

Preferably, the plurality of fins are bonded to the first face for heat exchange with the air drawn into the case.

The air cleaner preferably further includes an air guide having one end in communication with the fan, and the other end in communication with the outlet, and a flow passage which becomes the larger as it goes from the one end toward the other end the farther.

The plurality of fins are preferably provided in the air guide, for uniform guide of the air from the fan to an entire area of the outlet.

The air cleaner preferably further includes a partition wall inside of the case having a space independent from the space the air drawn into the case flows therethrough, and the heat exchanger provided thereto passed through one side thereof.

Preferably, the heat exchanger includes a thermoelectric module passed through the one side of the partition wall, a first face at one side of the thermoelectric module for heat exchange with the air drawn into the case, and a second face at the other side of the thermoelectric module inside of the partition wall.

Preferably, the plurality of fins are bonded to the first face for heat exchange with the air drawn into the case.

The case preferably further includes a hole for making the inside of the partition wall and an outside of the case in communication.

Preferably, the air cleaner further includes a fan inside of the partition wall for blowing air toward the heat exchanger.

The air cleaner preferably further includes an insulating material inside of the partition wall for preventing the air inside of the partition wall from heat exchanging with the air drawn into the case.

The partition wall is preferably provided to the air guide having one end in communication with the fan, and the other end in communication with the outlet, and a flow passage which becomes the larger as it goes from the one end toward the other end the farther.

The air cleaner preferably further includes a first sensor in the case for measuring a temperature of the air drawn into the case to determine if the heat exchanger is made to generate or absorb heat according to the room temperature.

The case preferably further includes a second senor for measuring a temperature of the air discharged toward the outlet, and the heat exchanger has a heat exchange rate controlled according to a temperature of the air measured at the first sensor and the second sensor.

It is to be understood that both the foregoing description and the following detailed description of the present invention are exemplary and explanatory and are intended to provide further explanation of the invention claimed.

BRIEF DESCRITPION OF THE DRAWINGS

The accompanying drawings, which are included to provide a further understanding of the invention and are incorporated in and constitute a part of this application, illustrate embodiment(s) of the invention and together with the description serve to explain the principle of the invention.

DETAILED DESCRIPTION OF THE PREFERRED EMBODIMENT

Figure 1:
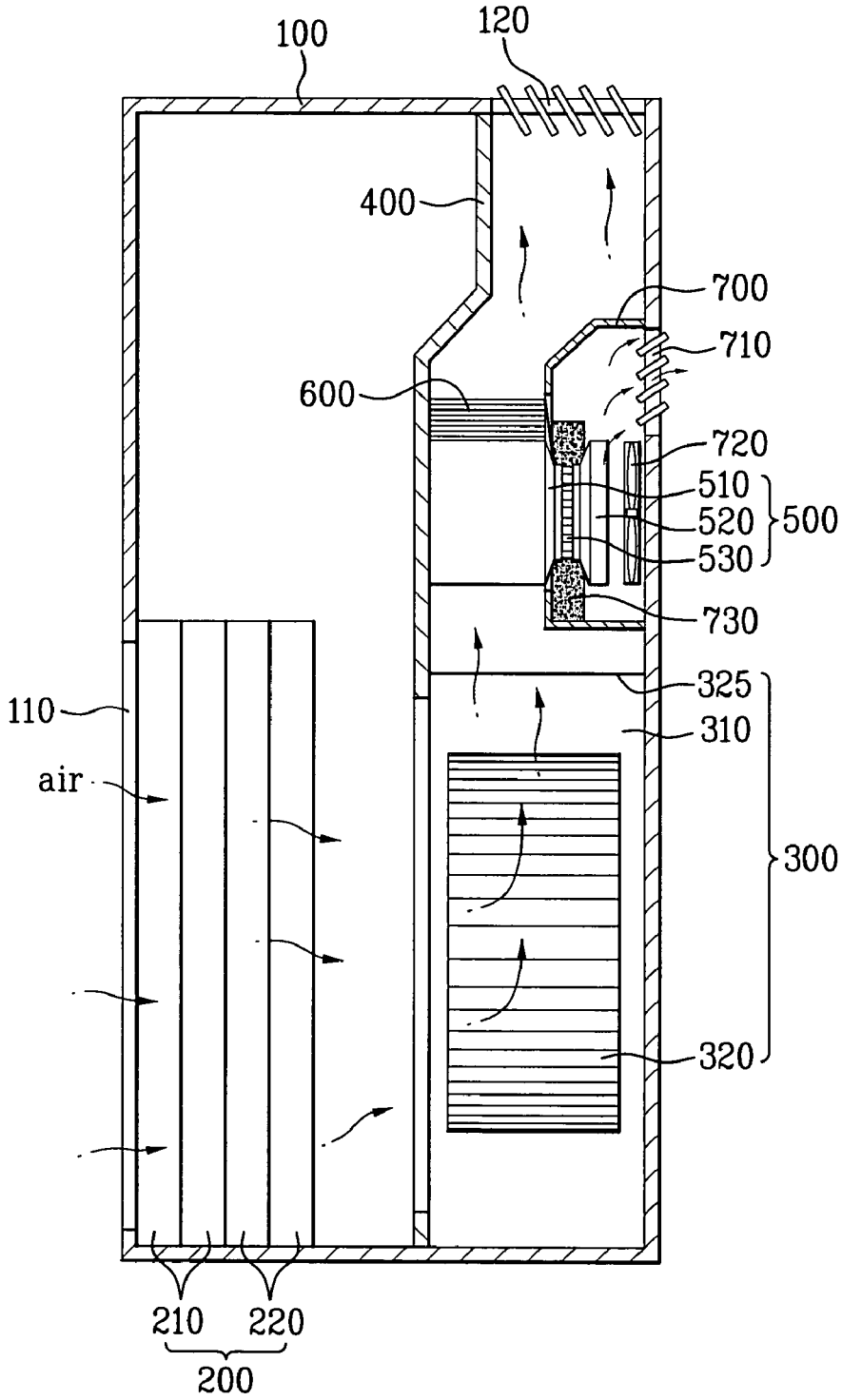
FIG. 1 illustrates a side section of an air cleaner in accordance with a preferred embodiment of the present invention.

Reference will now be made in detail to the preferred embodiments of the present invention, examples of which are illustrated in the accompanying drawings. In describing the embodiments, identical parts will be given the same names and reference symbols, and repetitive description of which will be omitted. FIG. 1 illustrates a side section of an air cleaner in accordance with a preferred embodiment of the present invention.

Referring to FIG. 1, the air cleaner includes a case 100, a fan 300, a filter assembly 200, and a plurality of fins 600.

The case 100, forming an outer appearance of the air cleaner, has an inlet 110 for drawing room air, and an outlet 120 for discharging cleaned air. The inlet 110 is in a front of the case 100, and the outlet 120 is in a top of the case 100. The outlet has a louver for regulating a discharge direction of the air.

However, the inlet 110 and the outlet may be formed in other positions. For an example, the inlet 110 may be formed in a central part or an upper part of the front of the case 100, or either side of the case 100. The outlet 120 may be formed in a central part or front part of the top of the case 100, or either side of the case 100.

In the meantime, the fan 300 is installed on an inside of the case 100, more specifically between the inlet 110 and the outlet 120. The fan draws room air through the inlet 110 and discharges through the outlet 120.

Figure 2:
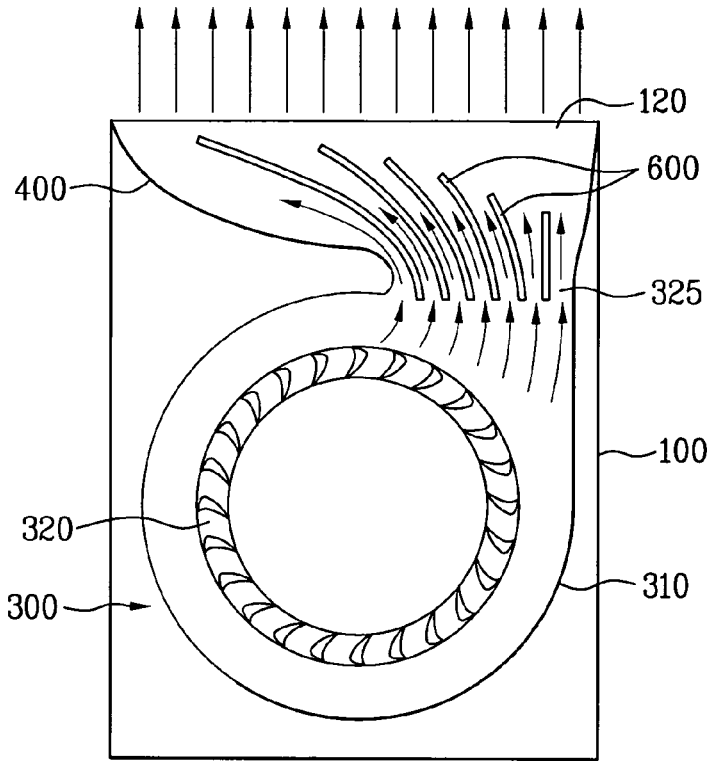
FIG. 2 illustrates a front section of an air cleaner in accordance with a preferred embodiment of the present invention.

The fan 300 includes a motor, an impeller 320, and a housing 310. The housing holds the motor and impeller 320. The impeller 320 draws outside air by a rotating force of the motor. The housing 310 gathers and guides drawn air to an outside of the fan 300. For guiding the drawn to the outside of the fan 300, the housing 310 has one opened side to form an outlet 325 of the fan 300, for guiding the air passed through the impeller 320 to an outside of the housing 310. As shown in FIG. 2, the outlet 325 of the fan 300 is positioned to face the outlet 120. The fan 300 is, for an example, a sirocco fan which draws air in an axial direction and discharges the air in a circumferential direction.

In the meantime, the filter assembly 200 is inside of the case 100, more specifically, the filter assembly 200 is inside of the case 100 adjacent to the inlet 110, and includes a first filter 210 and a second filter 220.

The first filter 210 adjacent to the inlet 110, for removing dust from room air introduced thereto through the inlet 110. The second filter 220 is in rear of the first filter 210 for removal of fine dust and smell particles from the room air passed through the first filter 210.

Besides the first filter 210 and the second filter 220, the filter assembly may further include at least one of an UV lamp and an ion generator. The UV lamp emits a UV ray, and it is known that the UV ray sterilizes. Since the UV lamp that emits the UV ray thus is used widely in a purpose of sterilization and the like, description of a system of the UV lamp will be omitted.

The ion generator generates anions which sterilize air supplied to the room. Such an ion generator is used widely, of which one example of ion generation will be described.

For an example, if a high voltage is applied to a point tip, oxygen O2 in the vicinity of the tip becomes ozone, i.e., an anion having one more oxygen atom bonded thereto. It is known that the ozone has an excellent oxidization capability, with a sterilizing effect. Moreover, the ozone bonds with a pollutant, such as a particle of positive charge, which is attached to an ion filter, if any, to show even an air cleaning effect.

In the meantime, the plurality of fins 600 are provided between the fan 300 and the outlet 120, for guiding the air introduced into the case 100 to the outlet 120. The plurality of fins 600 prevent turbulence from forming in guiding the air from the fan 300 to the outlet 120, to make the air to flow smoothly. The plurality of fins 600 will be described with reference to FIG. 2.

Referring to FIG. 2, the plurality of fins 600 guides the air drawn into the inside of the case 100 to an entire area of the outlet 120. For guiding the air from the fan 300 to an entire area of the outlet 120, the plurality of fins 600 are fitted starting from the outlet 325 of the fan 300 to the outlet 120 of the case 100, and have various lengths.

The lengths of the fins 600 become the longer as the fins 600 are positioned the farther from the outlet 325 of the fan 300 to the outlet 120 of the case 100. Or, the lengths of the fins 600 are proportional to distances from the outlet 325 of the fan 300 to the outlet 120 of the case 100.

Moreover, a distance between adjacent fins 600 becomes the greater as it goes the farther from the outlet 325 of the fan 300 to the outlet 120 of the case 100, for uniform guidance of the air to an entire area of the outlet 120. The fins 600 may be flat, or curved for smooth flow of the air, and may be connected to a heat exchanger 500 described later.

In the meantime, the room air is drawn into the case 100 through the inlet 110 by the fan 300. The air drawn thus is cleaned at the filter assembly 200, and provided to the fan 300. Then, the air is provided from the fan 300 to the room through the plurality of fins 600 and the outlet 120.

The plurality of fins 600 provided thus prevent formation of turbulence of the air flowing from the fan 300 to the outlet 120, and discharge the air through entire area of the outlet 120 uniformly.

In the meantime, referring to FIG. 1, the heat exchanger 500 is mounted on an inside of the case 100, for selective heating or cooling of the air drawn into the inside of the case 100. The heat exchanger 500 is provided in an air passage in the case 100, for heating or cooling cleaned air so that the room is maintained within a temperature range comfortable for living in the room.

In more detail, the heat exchanger 500 includes a thermoelectric module 530 which has one end for generating heat and the other end for absorbing heat if a current is applied thereto, or the one end for absorbing heat and the other end for generating heat if a direction of the current is reversed.

The thermoelectric module 530 has a low temperature part for absorbing heat from an environment, and a high temperature part for emitting heat to the environment, by the peltier effect, which will be described.

The peltier effect is a phenomenon in which, if a current is applied to a middle of a loop of different kinds of metal, heat is generated at one bonded part, and heat is absorbed at the other bonded part.

For an example, after a module is fabricated of an 'n', and a 'p' type thermoelectric semiconductors connected in series in view of electricity, and in parallel in view of heat, if a DC current is applied thereto, a temperature difference is occurred between opposite faces of the module by the thermoelectric effect in which heat is absorbed at a bonded point charged with a negative potential as electrons having heat absorbed from the environment emigrate toward an inner part of the thermoelectric semiconductor, and heat of electrons is emitted from a bonded point charged with a positive potential.

The thermoelectric module 530 having the high temperature part and the low temperature part by the peltier effect may be called as a small sized heat pump without moving parts, and has the following features.

First, the thermoelectric module 530, having no moving parts, is operative without noise and vibration. Second, cooling rate is high, and accurate temperature control is possible. Third, positions of the low temperature part and the high temperature part can be exchanged by changing a flow direction of the current. Fourth, size is small, and weight is light, and local cooling is possible. Fifth, since no refrigerant gas is used, there is no limitation of space of use, and the thermoelectric module 530 is environment friendly.

Accordingly, the present invention employs the thermoelectric module 530 having the foregoing features instead of the refrigerant in designing the air conditioner.

The heat exchanger 500 includes a first face 510, a second face 520, and the thermoelectric module 530.

The first face 510 is arranged to be in contact with the air drawn into the case 100, for generating/absorbing heat. The air drawn into the case 100 is heated or cooled at the first face 510, and discharged into the room.

The second face 520 is arranged not to be in contact with the air drawn into the case 100, and makes reaction opposite to the first face 510. When the first face 510 absorbs heat, the second face 520 generates heat, and vice versa.

The thermoelectric module 530 connects the first face 510 and the second face 520, and supply heat sources to the first face 510 and the second face 520 for making heat exchange at the first face 510 and the second face 520.

Figure 3:
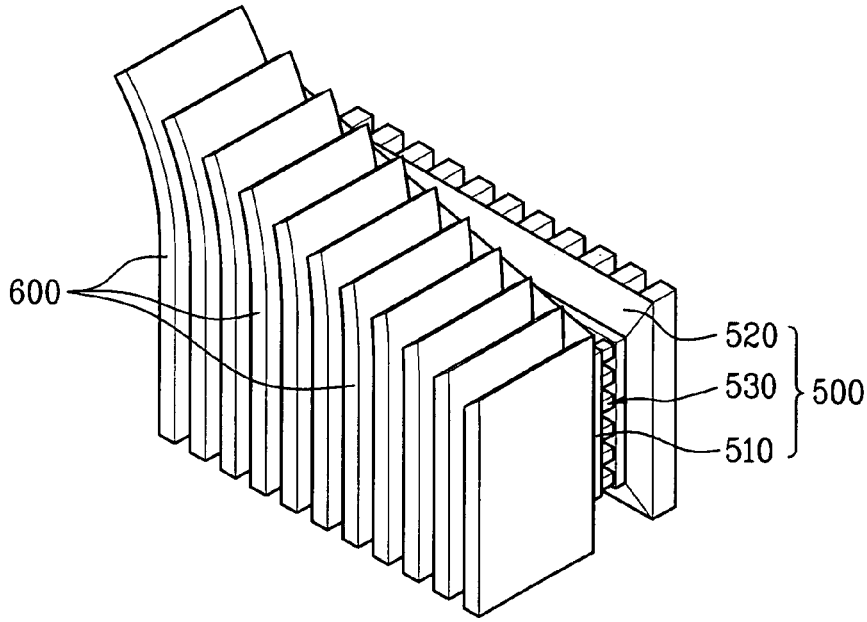
FIG. 3 illustrates a perspective view of a heat exchanger and fins in accordance with a preferred embodiment of the present invention.

Referring to FIG. 3, the plurality of fins 600 may be bonded to the first face 510. The bonding of the plurality of fins 600 provides a larger area to be in contact with the air drawn into the case 100, that enables more effective heat exchange at the fins 600. The fins 600 have the lengths and forms described before. Accordingly, the heat exchanger 500 bonded with the fins 600 and provided in the air passage enables more effective heat exchange. Moreover, as described before, the fins 600 guide the air passed through the fan 300 to an entire area of the outlet 120, uniformly.

Referring to FIG. 2, there is an air guide 400 between the fan 300 and the outlet 120, for guiding the air to the outlet 120. The air guide 400 has one end in communication with the housing 310 of the fan 300, and the other end in communication with the outlet 120. The air guide 400 has a flow passage which becomes the larger as it goes from the one end toward the other end the farther.

The plurality of fins 600 may be mounted inside of the air guide 400. If the fins 600 are mounted inside of the air guide 400 thus, the air passed through the air guide flows more smoothly as the turbulence is suppressed by the fins 600. Moreover, the air is discharged from the fan 300 through the entire area of the outlet 120 connected to the other end of the air guide 400 by the fins 600. The lengths and forms of the plurality of fins 600 can be fixed as described before.

In the meantime, referring to FIG. 1, the case 100 has a partition wall 700. The partition wall 700 forms a space independent from a space the air drawn into the case 100 flows therethrough, and has the heat exchanger 500 passed through one side surface thereof.

The partition wall 700 has the one side surface having the thermoelectric module 530 connecting the first face 510 and the second face 520 passed therethrough. There is the first face 510 between the partition wall 700 and the case 100 at one side of the thermoelectric module 530 for heat exchange with the air drawn into the case 100. There is the second face 520 inside of the partition wall 700 at the other side of the thermoelectric module 530 for making a reaction of heat exchange opposite to a reaction of the first face 510.

The case 100 further includes a hole 710 for making the inside of the partition wall 700 and an outside of the case 100 in communication. For making the heat exchange at the second face 520 more smoother, it is required to supply the room air into an inside of the partition wall 700. The hole 710 guides the room air to the inside of the partition wall 700, to make the heat exchange at the second face 520 more smoother.

There is a fan 720 inside of the partition wall 700. The fan 720 blows air to the heat exchange 500, for making smooth heat exchange at the heat exchanger 500. The heat exchanger 500 inside of the partition wall 700 is the second face 520. The air heat exchanged at the second face is discharged to the room. However, since the air has a small amount, the air gives no influence to a temperature of the room air.

In the meantime, in order to prevent the air inside of the partition wall 700 from making heat exchanging with the air drawn into the case 100, the partition wall 700 has an insulating material provided thereto. The insulating material is provided to the partition wall 700 for preventing the heat exchange at the first face from influencing the heat exchange at the second face, and vice versa. The insulating material 730 may surround the heat exchanger 500 or provided to entire partition wall 700. Of course, the partition wall 700 may be formed of an insulating material without providing the insulating material 700, separately.

The partition wall 700 may be provided to the air guide 400. In a case the partition wall 700 is provided to the air guide 400, to position the heat exchanger 500 provided to the partition wall 700 in a flow passage of the air drawn into the case 100, the heat exchange can be made more effectively, and the structure of the air cleaner can be comparatively simple.

Figure 4:
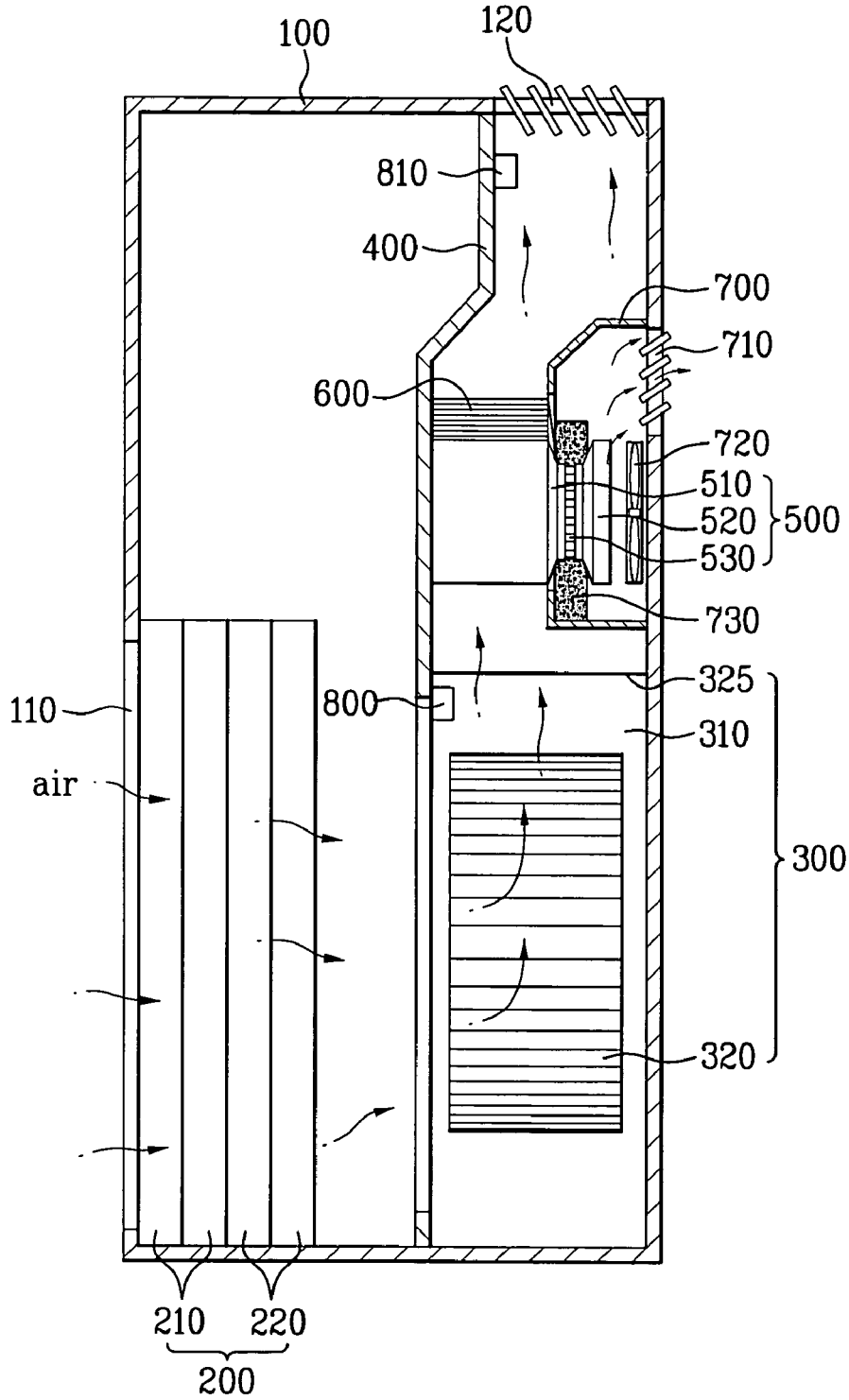
FIG. 4 illustrates a side section of an air cleaner in accordance with a preferred embodiment of the present invention having a sensor further included thereto.

In the meantime, the air cleaner of the present invention may further include a sensors. Referring to FIG. 4, the case 100 is provided with a first sensor 800. The first sensor 800 measures a temperature of the room air drawn into the case 100 through the inlet 110. For more accurate measurement of the temperature of the room air, the first sensor 800 is provided in a neighborhood of the inlet 110. The first sensor may measure, not only the temperature, but also composition of the air. According to the room temperature measured at the first sensor 800, the controller determines heat absorption/generation of the heat exchanger 500.

For more accurate measurement of the temperature of the room air, the air cleaner of the present invention is further provided with a second sensor 810. The second sensor measures a temperature of the air discharged to the outlet 120 of the case 100, and is provided in a neighborhood of the outlet 120 for more accurate measurement of the temperature of the discharged air.

The operation of the air cleaner of the present invention will be described.

The fan 300 is put into operation, to draw room air into the case 100 through the inlet 110. The air drawn into the case 100 is cleaned at the first, and second filters 210 and 220 of the filter assembly 200. The first filter 210 removes dust from the room air passing therethrough, and the second filter 220 removes fine dust and smell particles from the room air. The cleaned air is provided to the air guide 400 through the fan 300.

The air guide 400 is provided with a partition wall 700 having a space independent from the space the cleaned air flows therethrough. The partition wall 700 has the heat exchanger 500, having the first face 510 and the second face 520 for making heat exchange, and the thermoelectric module 530, provided to one side thereof. The first face 510 is in contact, and heat exchange, with the cleaned air. The second face 520 is in the partition wall 700, and not in contact with the cleaned air, but makes a reaction opposite to a heat exchange reaction at the first face 510. The thermoelectric module 530 connects the first face 510 and the second face 520. The first face 510 has the plurality of fins 600 bonded thereto, for heating or cooling the cleaned air selectively, altogether.

The plurality of fins 600 heat exchange with the cleaned air, and guide the cleaned air to entire area of the outlet 120 for uniform supply of the cleaned air to the room.

The fan 720 is provided inside of the partition wall 700 for blowing air to the second face 520, and the hole 710 is provided to the case 100 for making the inside of the partition wall in communication with the room.

In the meantime, the operation of the air cleaner of the present invention having the sensor further included thereto will be described.

The room temperature is measured at the first sensor 800, and transmitted to a controller. Then, the controller compares a data from the first sensor 800 to a preset data, to determine the present season. By identifying the room air temperature of falling on a summer temperature range or a winter temperature range, a season is identified.

The information on the room air temperature is measured at the first sensor 800, and transmitted to the controller. The controller identifies the present season by comparing the data measured at the first sensor 800 with a preset data on a temperature. For an example, by identifying the room air temperature of falling on a summer temperature range or a winter temperature range, the season is identified. Of course, the determination and identification of the season can be selected by the user's direct operation on a control panel.

Once the season is identified, the controller controls direction and intensity of a current applied to the heat exchanger 500 with reference to the season and the present temperature.

For an example, if the identified season is summer, and the present room air temperature is, for an example, 27° C., the controller controls a direction of application of the current so that the first face 510 of the heat exchanger 500 makes a heat absorption reaction, and the second face 520 makes a heat generation reaction, and intensity of the current so that the cleaned air has a temperature lower than the room air temperature outside of the air cleaner by 1~3° C. (preferably in a range of 2° C.) after heat exchanged at the first face 510. Then, the cleaned air discharged through the outlet 120 cools the room, thereby providing a comfortable room environment.

If the identified seasons is winter, and the present room air temperature is, for an example, 18° C., the controller controls the direction of application of the current so that the first face 510 of the heat exchanger 500 makes a heat generation reaction, and the second face 520 makes a heat absorption reaction, and intensity of the current so that the cleaned air has a temperature higher than the room air temperature outside of the air cleaner by 1~3° C. (preferably in a range of 2° C.) after heat exchanged at the first face 510. Then, the cleaned air discharged through the outlet 120 heats the room, thereby providing a comfortable room environment.

Moreover, the air cleaner of the present invention is not limited to control the temperature of the discharged air according to the season, simply. Depending on users, discharge of the air with a higher temperature or lower temperature may be desired.

The operation of the air cleaner in a case the second sensor is provided further will be described.

A heat exchange rate of the heat exchanger 500 is controlled according to an air temperature measured at the first sensor 800 and the second sensor 810.

In more detail, if the user desires the air temperature discharged through the air cleaner is lower than the room air temperature by about 2° C., the controller identifies the room air temperature measured at the first sensor 800.

Then, the controller controls the intensity of current provided to the heat exchanger 500, so that the air temperature discharged through the air cleaner is lower than the room air temperature measured at the first sensor 800.

In this instance, after identifying that the discharged air temperature measured at the second sensor 810, the controller compares the discharged air temperature with the room temperature, and determines if the discharged air temperature is lower by the preset temperature range of 2° C.

If it is determined that the discharged air temperature is not lower by the range of 2° C., but by a range of 1° C. compared to the room air temperature in above comparison, the controller controls the current, so that the heat exchanger 500 cools the discharged air more, and if it is determined that the discharged air temperature is not lower by the range of 2° C., but by a range of 3° C. compared to the room air temperature in above comparison, the controller controls the current, so that the heat exchanger 500 cools the discharged air less.

In the meantime, if it is determined that the discharged air temperature is lower by the range of 2° C. compared to the room air temperature in above comparison, the controller maintains the intensity of the current provided to the heat exchanger 500.

Thus, by above series of steps, the air cleaner of the present invention provides cleaned air with a temperature suitable to a person in the room.

As has been described, the air ventilator and cleaner of the present invention has a plurality of fins for guiding the air drawn into the case to the outlet. Accordingly, the cleaned air can be discharged to entire area of the outlet, and provided to the room, uniformly.

Moreover, the air cleaner of the present invention can cool or heat the room taking a room temperature into account. Therefore, a comfortable environment can be provided to the user always, and user's satisfaction and reliability on the product can be improved.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. An air cleaner comprising:

a case having an inlet and an outlet;

a fan inside of the case, for drawing air through the inlet and discharging the air through the outlet;

a filter assembly inside of the case for cleaning the air drawn into the case through the inlet;

a heat exchanger inside of the case for heating or cooling the air drawn into the case, selectively; and a plurality of fins between the fan and the outlet, wherein the fins guide the air drawn into the case to substantially an entire area of the outlet, wherein the fan comprises:

an impeller which draws outside air and discharges the drawn air; and a housing in which the impeller is installed, wherein the housing has an outlet, and gathers and guides the drawn air to the outlet of the housing, wherein the fins are provided between the outlet of the housing and the outlet of the case.

2. The air cleaner as claimed in claim 1, wherein the plurality of fins have a distance between adjacent fins which becomes the greater as it goes toward the outlet the farther.

3. The air cleaner as claimed in claim 1, wherein the plurality of fins have lengths which become the longer as the fins are arranged at positions of which distances from an outlet of the fan to the outlet of the case are the greater.

4. The air cleaner as claimed in claim 1, wherein the plurality of fins have lengths which are fixed in proportion to distances from an outlet of the fan to the outlet of the case.

5. The air cleaner as claimed in claim 1, wherein the plurality of fins are curved for smooth air flow.

6. The air cleaner as claimed in claim 1, wherein the heat exchanger includes a thermoelectric module having one end for generating heat and the other end for absorbing heat if a current is applied thereto, or the one end for absorbing heat and the other end for generating heat if a direction of the current is reversed.

7. The air cleaner as claimed in claim 1, wherein the heat exchanger includes;

a first face arranged to be in contact with the air drawn into the case, for generating/absorbing heat, a second face arranged not to be in contact with the air drawn into the case, for making a reaction opposite to the first face, and a thermoelectric module connected between the first face and the second face.

8. The air cleaner as claimed in claim 7, wherein the plurality of fins are bonded to the first face for heat exchange with the air drawn into the case.

9. The air cleaner as claimed in claim 1, further comprising an air guide having one end in communication with the fan, and the other end in communication with the outlet, and a flow passage which becomes the larger as it goes from the one end toward the other end the farther.

10. The air cleaner as claimed in claim 9, wherein the plurality of fins are provided in the air guide, for uniform guide of the air from the fan to an entire area of the outlet.

11. The air cleaner as claimed in claim 1, further comprising a partition wall inside of the case having a space independent from the space the air drawn into the case flows therethrough, and the heat exchanger provided thereto passed through one side thereof.

12. The air cleaner as claimed in claim 11, wherein the heat exchanger includes;

a thermoelectric module passed through the one side of the partition wall, a first face at one side of the thermoelectric module for heat exchange with the air drawn into the case, and a second face at the other side of the thermoelectric module inside of the partition wall.

13. The air cleaner as claimed in claim 12, wherein the plurality of fins are bonded to the first face for heat exchange with the air drawn into the case.

14. The air cleaner as claimed in claim 11, wherein the case further includes a hole for making the inside of the partition wall and an outside of the case in communication.

15. The air cleaner as claimed in claim 11, further comprising a fan inside of the partition wall for blowing air toward the heat exchanger.

16. The air cleaner as claimed in claim 11, further comprising an insulating material inside of the partition wall for preventing the air inside of the partition wall from heat exchanging with the air drawn into the case.

17. The air cleaner as claimed in claim 11, wherein the partition wall is provided to the air guide having one end in communication with the fan, and the other end in communication with the outlet, and a flow passage which becomes the larger as it goes from the one end toward the other end the farther.

18. The air cleaner as claimed in claim 1, further comprising a first sensor in the case for measuring a temperature of the air drawn into the case to determine if the heat exchanger is made to generate or absorb heat according to the room temperature.

19. The air cleaner as claimed in claim 18, wherein the case further includes a second senor for measuring a temperature of the air discharged toward the outlet, and the heat exchanger has a heat exchange rate controlled according to a temperature of the air measured at the first sensor and the second sensor.

20. The air cleaner as claimed in claim 1, wherein the impeller draws air in an axial direction and blows the drawn air in a radial direction.

21. The air cleaner as claimed in claim 20, wherein a width from the outlet of the housing becomes wider toward the outlet of the case.

22. The air cleaner as claimed in claim 21, wherein the fins have a distance between adjacent fins which becomes the greater as it goes toward the outlet of the case the farther, wherein the fins have lengths which become the longer as the fins are arranged at positions of which distances from the outlet of the housing to the outlet of the case are the greater.

23. The air cleaner as claimed in claim 21, wherein the fins have a distance between adjacent fins which becomes the greater as it goes toward the outlet of the case the farther, wherein the fins have lengths which are fixed in proportion to distances from the outlet of the housing to the outlet of the case.

* * * * *